US007692371B2

(12) United States Patent
Lu et al.

(10) Patent No.: US 7,692,371 B2
(45) Date of Patent: Apr. 6, 2010

(54) ELECTRODE FOR THE SOURCE OF FIELD EMITTING ELECTRONS AND A PANEL AND A LIGHTING APPARATUS THEREOF

(75) Inventors: Li-Yung Lu, Taipei (TW); Zhi-Ming Hong, Taipei (TW); Tzung-Han Yang, Taipei (TW)

(73) Assignee: Tatung Company, Taipei (TW)

( * ) Notice: Subject to any disclaimer, the term of this patent is extended or adjusted under 35 U.S.C. 154(b) by 222 days.

(21) Appl. No.: 12/000,368

(22) Filed: Dec. 12, 2007

(65) Prior Publication Data

US 2008/0303405 A1 Dec. 11, 2008

(30) Foreign Application Priority Data

Jun. 8, 2007 (TW) ..... 96120870 A

(51) Int. Cl.
*H01J 1/62* (2006.01)

(52) U.S. Cl. ..... 313/495; 313/309

(58) Field of Classification Search ..... 313/309, 313/310, 336, 351, 495
See application file for complete search history.

(56) References Cited

U.S. PATENT DOCUMENTS 3,720,856 A * 3/1973 Brody ..... 313/309
5,038,070 A * 8/1991 Bardai et al. ..... 313/309

* cited by examiner

*Primary Examiner*—Vip Patel
(74) *Attorney, Agent, or Firm*—Bacon & Thomas, PLLC

(57) ABSTRACT

The present invention relates to an electrode for a source of field emitting electrons and a lighting panel and a lighting apparatus thereof. A plurality of conductive emitters made from a combination of an electrical emitting source material and an electrical conductive material is formed on a cathode plate. Therefore, the conductive emitter can be a cathode, a gate and a field emitting electric source as well to simplify the structure and the process, and improve the brightness and uniformity thereof.

19 Claims, 4 Drawing Sheets

ELECTRODE FOR THE SOURCE OF FIELD EMITTING ELECTRONS AND A PANEL AND A LIGHTING APPARATUS THEREOF

BACKGROUND OF THE INVENTION

1. Field of the Invention

This present invention relates to an electrode for a source of field emitting electrons and a lighting panel and a lighting apparatus thereof.

2. Description of Related Art

Generally, the conventional display device uses a lamp such as cold cathode fluorescent lamp, a hot cathode fluorescent lamp, or a light emitting diode to be the backlight source. However, the large size display device has been developed due to the growth of manufacturing technique and lighting area of panels. If the large size display device uses an unsuitable device as a backlight source, the large size display device will have some defects such as weakened structure or mercury pollution. If the light emitting diode is applied to a backlight source, the light from the light emitting diode cannot spread uniformly on the surface of the backlight source, and therefore some optics diaphragms are applied to spread the light on the surface of the backlight source uniformly. Consequently, the field emission panel has been developed for solving the aforementioned problems.

The field emission panel applies high voltage to the gate of triode for controlling emission of electrons on the lower substrate. The electron outputted from the lower substrate is attracted by the upper substrate capable of impacting the fluorescent material disposed on the upper substrate so as to absorb some energy of the electron for stimulating the fluorescent material to emit light.

However, the conventional gate of the field emission lighting panel and the conductive emitter should be manufactured separately which leads to increase manufacturing difficulty, low yield, and low capacity.

SUMMARY OF THE INVENTION

The object of the present invention is to provide a simple structure of an electrode for the source of field emitting electrons and a panel and a lighting apparatus thereof.

Another object of the present invention is to provide an electrode for the source of field emitting electrons and a panel and a lighting apparatus thereof to increase brightness and uniformity of the field emission backlight panel.

For achieving the above-mentioned objects, the present invention provides a field emission lighting panel comprising: an upper substrate having a layer of fluorescent material and an anode; a lower substrate having a plurality of conductive emitters; and a spacer disposed between the upper substrate and the lower substrate; wherein each of the conductive emitters is made of an electrical emitting source material and an electrical conductive material.

For achieving the above-mentioned objects, the present invention provides a field emission lighting apparatus, comprising: an upper substrate having a layer of fluorescent material and an anode; a lower substrate having a plurality of conductive emitters; a spacer disposed between the upper substrate and the lower substrate; and a driving unit electrically connected to the plurality of conductive emitters; wherein each of the conductive emitters is made of an electrical emitting source material and an electrical conductive material.

The structure of the upper substrate and the lower substrate respectively are not limited thereto, preferably are construed of a plate structure, and the upper substrate is more preferably a transparent plate with fluorescent material. The spacer can be made of any kind of material, preferably, but not limited to the materials such as glass, polyimide, or other vacuum or high-pressure materials.

Each emitter is preferably construed to be a bar, zigzag, or wave structure by using screen printing or inkjet technique. The electrical source material is a low work function material such as silicon, metal, or carbon base material, and preferably polysilicon, molybdenum, niobium, diamond membrane, carbon nano-tubes, or graphite. The conductive material can be made of any material, as long as the material has conductivity, preferably is copper, silver, gold, or nickel.

The plurality of emitters can receive a plurality of driving signals for controlling voltage thereof. While the driving signal controls the voltage of one emitter to be a gate and maintained at a high voltage, the other emitters adjacent to the gate maintained at low voltage will output at least one electron corresponding to the emitter maintained at the high voltage. The driving signal preferably controls the emitter to output electrons alternately while the adjacent emitters transform voltage between high voltage and low voltage at different time intervals.

A power supply unit is electrically connected to the field emission lighting apparatus, and a voltage transformer is electrically connected to the lower substrate and the driving unit for transforming the voltage of the driving signal.

Therefore, this present provides a plurality of conductive emitters composed of an electrical emitting source material and an electrical conductive material as a gate or a field emission electrical source so as to simplify structure and increase brightness and uniformity of the field emission lighting apparatus.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
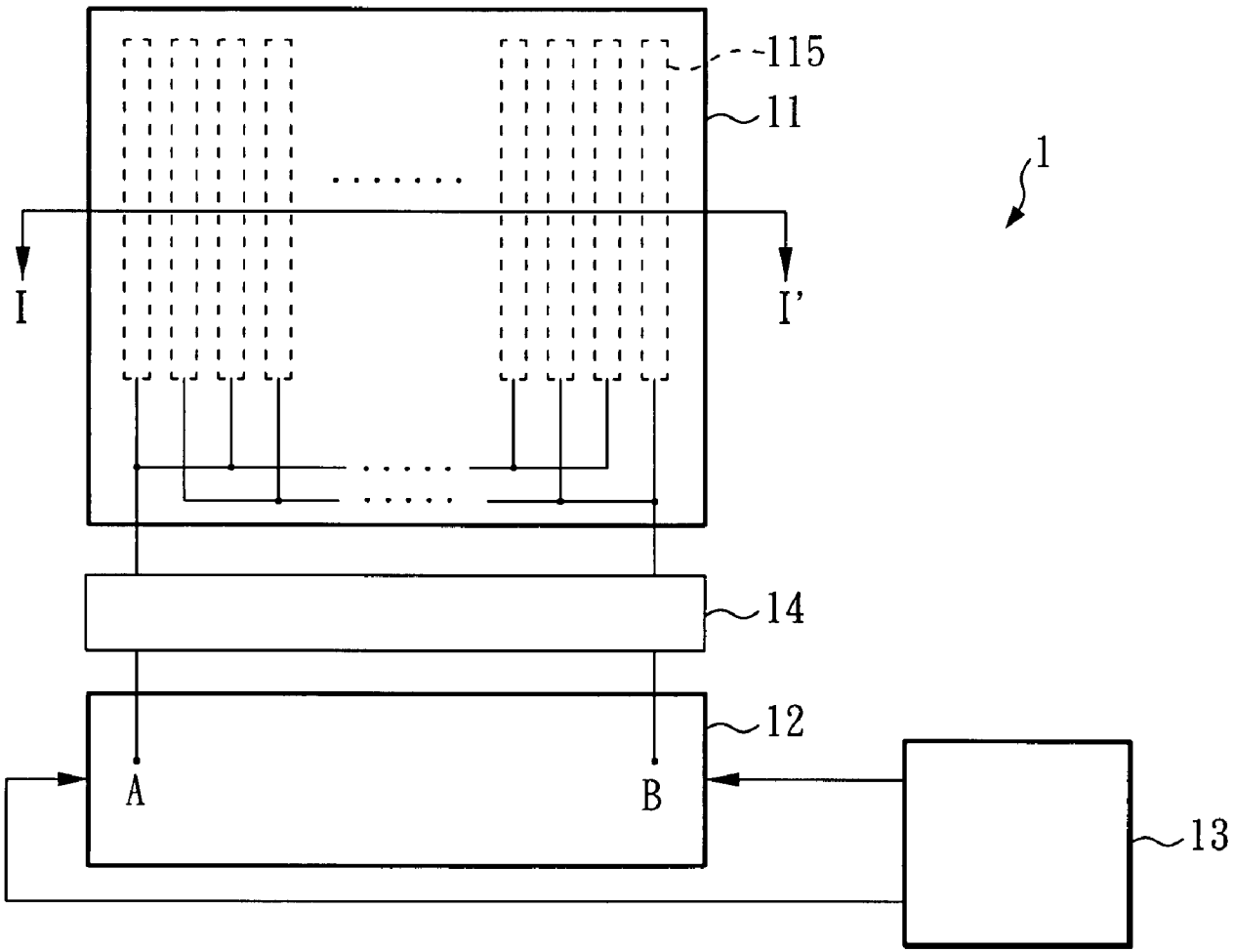
FIG. 1 shows a schematic view of the field emission lighting apparatus of the first preferred embodiment according to this present invention.

Referring to FIG. 1, the field emission lighting apparatus 1 comprises a field emission lighting panel 11, a driving unit 12, a power supply unit 13 and a voltage transformer 14. The power supply unit 13 electrically connects to the driving unit 12, and the voltage transformer 14 electrically connects to the field emission lighting panel 11 and the driving unit 12.

Figure 2:
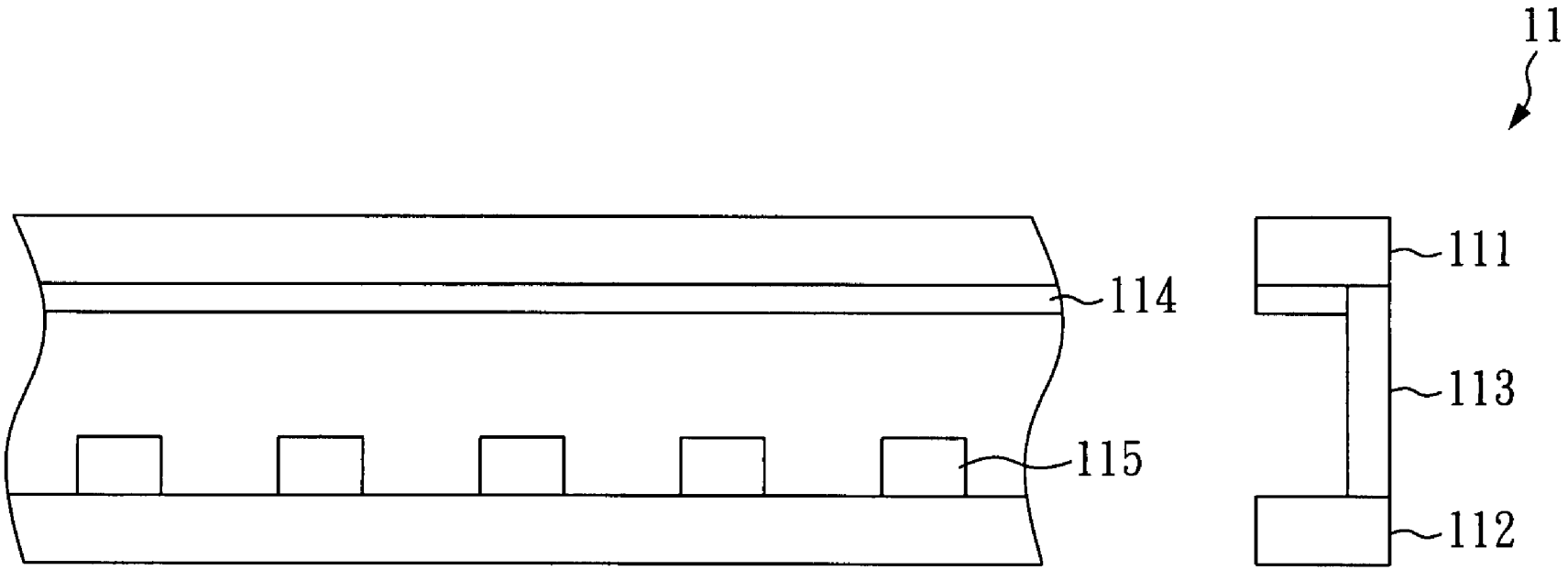
FIG. 2 is a cross-sectional view of the arrangement according to the field emission lighting apparatus of the first preferred embodiment according to this present invention.

FIG. 2 is a cross-sectional view of the arrangement according to the field emission lighting panel 11 of the FIG. 1 in the direction II'. Referring to FIG. 1 and FIG. 2, the field emission lighting panel 11 comprises an upper substrate 111, a lower substrate 112, and a spacer 113, and therefore the space is maintained in a low pressure status close to the vacuum status for preventing molecule pollution or damage to the lower substrate 112. In this embodiment, the pressure is maintained below $10^{-6}$ torr.

In this embodiment, a transparent electric conduction plate, such as Indium Tin Oxide (ITO), is formed on the upper substrate 111 as an anode. Before supplying a positive voltage to the upper substrate 111, a layer of fluorescent material 114 is formed on the upper substrate 111. The fluorescent material 114 is composed of high voltage fluorescent material or low voltage fluorescent material, and the difference between the two fluorescent materials is operation voltage. Therefore, while an electron with a voltage exceeding the operation voltage impacts on the fluorescent material 114, the fluorescent material 114 is stimulated to emit white light.

Figure 4A:
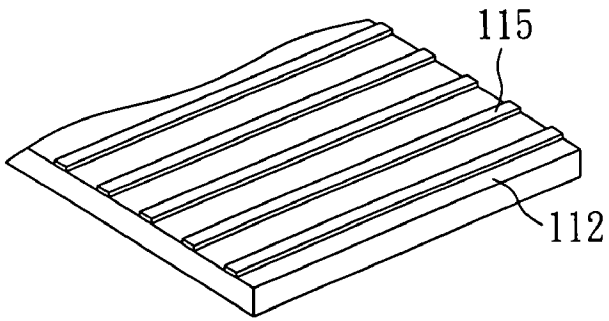
FIGS. 4A to 4C show schematic view of emitters can be a bar, zigzag, and wave structure.
Figure 4B:
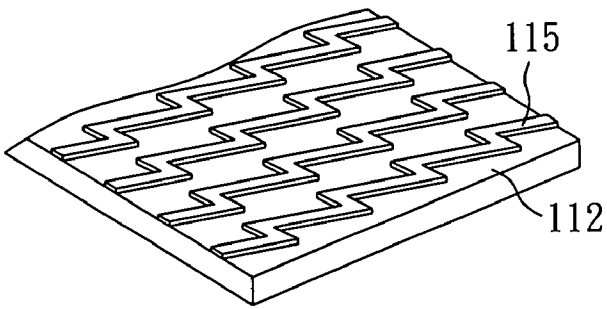
Figure 4C:
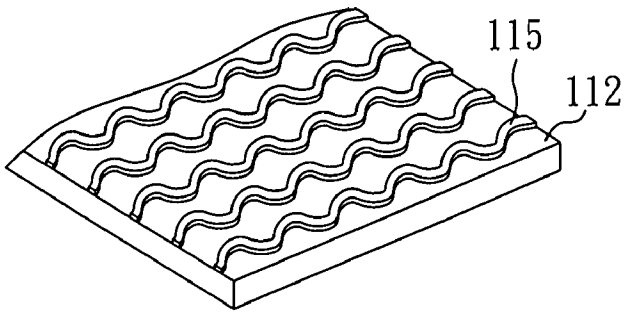

In this embodiment, the lower substrate 112 is a glass-based plate, and a plurality of emitters 115 is disposed on the lower substrate 112. Each emitter 115 is made of electronic source materials such as carbon nano-tube, and a conductive material such as a mixture composed of silver powder, ethyl cellulose and the terpineol. In addition, each emitter 115 is construed to a bar structure (as shown in FIG. 4A) by using screen printing technology on the lower substrate 112. In addition, each emitter 115 also can be a zigzag or wave structure as shown in FIG. 4B and 4C.

The spacer 113 is preferably composed of the polyamide having some advantageous features such as mechanical structure strengthening, located between the upper substrate 111 and the lower substrate 112 for maintaining a space and low pressure thereof.

Figure 3:
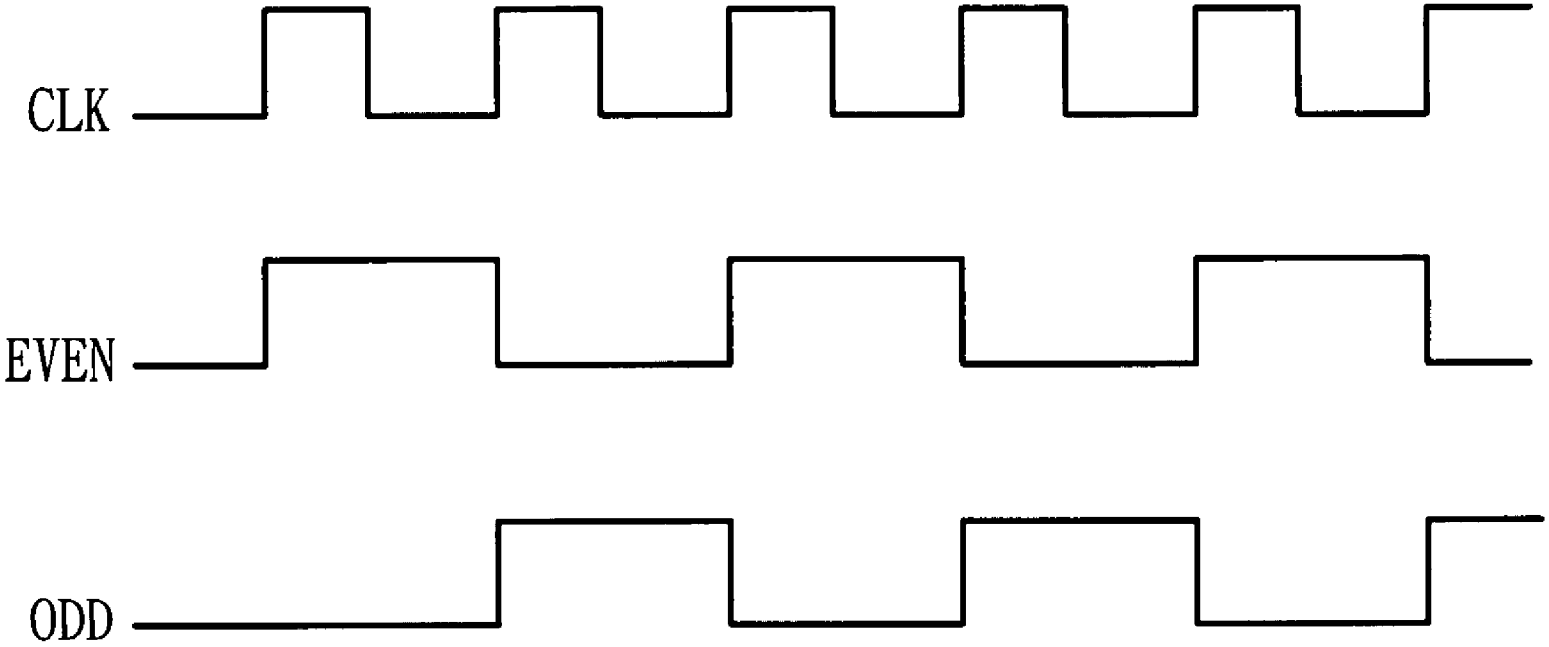
FIG. 3 shows a schematic view of electronic signal of the first preferred embodiment according to this present invention.

Subsequently, FIG. 3 shows a schematic view of the electrical signal of the preferred embodiment according to this present invention.

The scan driving unit 12 will generate a pair of driving signals such as the odd driving signal and the even driving signal. In this embodiment, the odd driving signal and the even driving signal respectively are also a cyclic square wave alternately circulated between a high reference voltage and a low reference voltage, and the odd driving signal has the same frequency with the even driving signal. In addition, the phase difference between the odd driving signal and the even driving signal is about 180 degrees, and the voltage difference between the odd driving signal and the even driving signal is 5 volts.

Further, the scan driving unit 12 transmits the odd driving signal and the even driving signal to the transformer 14 through the outputting end A, B respectively so as to enlarge the voltage difference between the odd driving signal and the even driving signal to 200 volts. After enlarging the voltage of the odd driving signal and the even driving signal, the transformer 14 inputs the driving signal to the emitters 115 located on the field emission panel 11 through two wires.

In this embodiment, each emitter 115 positioned at the odd number row of the plurality of emitters 115 electrically connects with each other, and each emitter 115 positioned at the even number row of the plurality of emitters 115 electrically connects with each other. The emitter 115 positioned at the odd number row of the plurality of emitters receives the odd driving signal, and the emitter 115 positioned at the even number row of the plurality of emitters receives the even driving signal. At this time, the voltage difference between the emitter 115 positioned at the odd number row of the plurality of emitters and the emitter 115 positioned at the even number row of the plurality emitters is 200 volts.

While the odd driving signal maintains in low reference voltage and the even driving signal maintains in high reference voltage, the voltage of the emitter 115 positioned at the odd number row of the plurality of emitters 115 is low reference voltage and the voltage of the emitter 115 positioned at the even number row of the plurality emitters 115 is high reference voltage. A huge electronic field is generated between the emitter 115 positioned at the odd number row of the plurality of emitters 115 and the emitter 115 positioned at the even number row of the plurality emitters 115 to output a plurality of electrons, and therefore the emitter 115 positioned at the odd number row of the plurality of emitters 115 is the source, and the emitter 115 positioned at the even number row of the plurality emitters 115 is gate. The electron transmitted by the emitter 115 positioned at the odd number row of the plurality of emitters 115 is attracted by a positive voltage of the upper substrate 111 to impact on the fluorescent material 114 for emitting lights.

However, while the odd driving signal is maintained in high reference voltage and the even driving signal is maintained in low reference voltage, the voltage of the emitter 115 positioned at the odd number row of the plurality of emitters 115 is high reference voltage and the voltage of the emitter 115 positioned at the even number row of the plurality emitters 115 is low reference voltage. At this time, a huge electronic field is generated between the emitter 115 positioned at the odd number row of the plurality of emitters 115 and the emitter 115 positioned at the even number row of the plurality emitters 115 to output a plurality of electrons for lighting the fluorescent materials 114.

Therefore, this present invention can provide a plurality of emitters as a gate or a field emission electrical source without further manufacturing any structure of the gate and the field emission electrical source during manufacturing process of the field emission lighting apparatus so as to simplify structure and increase brightness and uniformity of the field emission lighting apparatus.

Although the present invention has been explained in relation to its preferred embodiment, it is to be understood that many other possible modifications and variations can be made without departing from the scope of the invention as hereinafter claimed.

What is claimed is:

1. A field emission lighting panel, comprising:

an upper substrate having a layer of fluorescent material and an anode;

a lower substrate having a plurality of conductive emitters; and a spacer disposed between the upper substrate and the lower substrate;

wherein each of the conductive emitters is composed of an electrical source material and an electric conduction material.

2. The field emission lighting panel as claimed in claim 1, wherein each of the emitters is construed of a bar, zigzag, or wave structure.

3. The field emission light panel as claimed in claim 1, wherein two adjacent emitters respectively emit a plurality of electrons alternately.

4. The field emission light panel as claimed in claim 1, wherein the electrical emitting source material is silicon, metal, carbon base material, polysilicon, molybdenum, niobium, tungsten, graphite, diamond membrane, carbon nanotubes or the combination thereof.

5. The field emission light panel as claimed in claim 1, wherein the conductive material is copper, silver, gold, or nickel.

6. The field emission light panel as claimed in claim 1, wherein the plurality of emitters receive a plurality of driving signals for controlling voltage.

7. The field emission light panel as claimed in claim 1, wherein the adjacent emitters respectively has different voltage with each other at the same time interval.

8. The field emission light panel as claimed in claim 1, while the plurality of driving signals control the plurality of emitters to maintain at a low voltage, the plurality of emitters transmit at least one electron.

9. A field emission lighting apparatus, comprising:

an upper substrate having a layer of fluorescent material and an anode;

a lower substrate having a plurality of conductive emitters;

a spacer disposed between the upper substrate and the lower substrate; and a driving unit electrically connected to the plurality of conductive emitters;

wherein each of the conductive emitters is composed of an electrical emitting source material and an electric conduction material.

10. The field emission lighting apparatus as claimed in claim 9, wherein each of the emitters is construed of a bar, zigzag, or wave structure.

11. The field emission lighting apparatus as claimed in claim 9, wherein two adjacent emitters respectively emit a plurality of electrons alternately.

12. The field emission lighting apparatus as claimed in claim 9, wherein the electrical emitting source material is silicon, metal, carbon base material, polysilicon, molybdenum, niobium, tungsten, graphite, diamond membrane, carbon nano-tubes or the combination thereof.

13. The field emission lighting apparatus as claimed in claim 9, wherein the conductive material is copper, silver, gold, or nickel.

14. The field emission lighting apparatus as claimed in claim 9, wherein the plurality of emitters receive a plurality of driving signals for controlling voltage thereof.

15. The field emission lighting apparatus as claimed in claim 9, wherein the adjacent emitters respectively has different voltage with each other at the same time interval.

16. The field emission lighting apparatus as claimed in claim 9, while the plurality of driving signals control the plurality of emitters to maintain at a low voltage, the plurality of emitters transmit at least one electron.

17. The field emission lighting apparatus as claimed in claim 9, further comprising a power supply unit electrically connected to the driving unit.

18. The field emission lighting apparatus as claimed in claim 9, further comprising a voltage transformer electrically connected to the lower substrate and the driving unit.

19. The field emission lighting apparatus as claimed in claim 9, the driving unit provides a plurality of driving signals to the plurality of conductive emitters through a clock signal.

* * * * *